United States Patent [19]

Cassese

[11] Patent Number: 4,817,965

[45] Date of Patent: Apr. 4, 1989

[54] DEVICE FOR ASSEMBLING, BY CLIPPING, MOLDINGS INCORPORATING SEVERAL RABBETS

[76] Inventor: Antoine Cassese, Les Essarts No. 7,, Saint Germain-Laxis, Maincy, F77950, France

[21] Appl. No.: 97,413

[22] Filed: Sep. 15, 1987

Related U.S. Application Data

[63] Continuation of Ser. No. 636,980, Aug. 2, 1984, abandoned.

[30] Foreign Application Priority Data

Aug. 4, 1983 [FR] France ..... 83 132853

[51] Int. Cl.[4] ..... B27F 7/00; B27F 7/09

[52] U.S. Cl. ..... 227/3; 227/151; 227/152; 227/153

[58] Field of Search ..... 227/2, 3, 4, 151, 152, 227/153

[56] References Cited

U.S. PATENT DOCUMENTS 3,207,406 9/1965 Bowman ..... 227/130 X
3,597,142 8/1971 Jasper ..... 227/95
3,847,321 11/1974 Charlez ..... 227/7

FOREIGN PATENT DOCUMENTS 0062012 10/1982 European Pat. Off. .
7522814 2/1977 France .

*Primary Examiner*—P. W. Echols
*Assistant Examiner*—Taylor J. Ross
*Attorney, Agent, or Firm*—Christel, Bean & Linihan

[57] ABSTRACT

The invention relates to a device for assembling mouldings incorporating several rabbets, which comprises a table for positioning the mouldings, slides supporting this table, rendered fast with two columns which are connected in their lower part by a base under which is mounted a jack whose rod is connected to a hammer which penetrates in a clip magazine, and in their upper part by a piece provided with a presser member located opposite the hammer. According to the invention, a clipping assembly is provided which bears the hammer and a sliding guide fast with the hammer, as well as a sensor; two small columns on which the clipping assembly may slide vertically; balancing means mounted on each small column below the clipping assembly; and a plate disposed at the top of the rod, and on which the hammer and the sliding guide rest, and which comprises a matching member opposite the sensor. The invention is more particularly applicable to the manufacture of wooden frames.

8 Claims, 5 Drawing Sheets

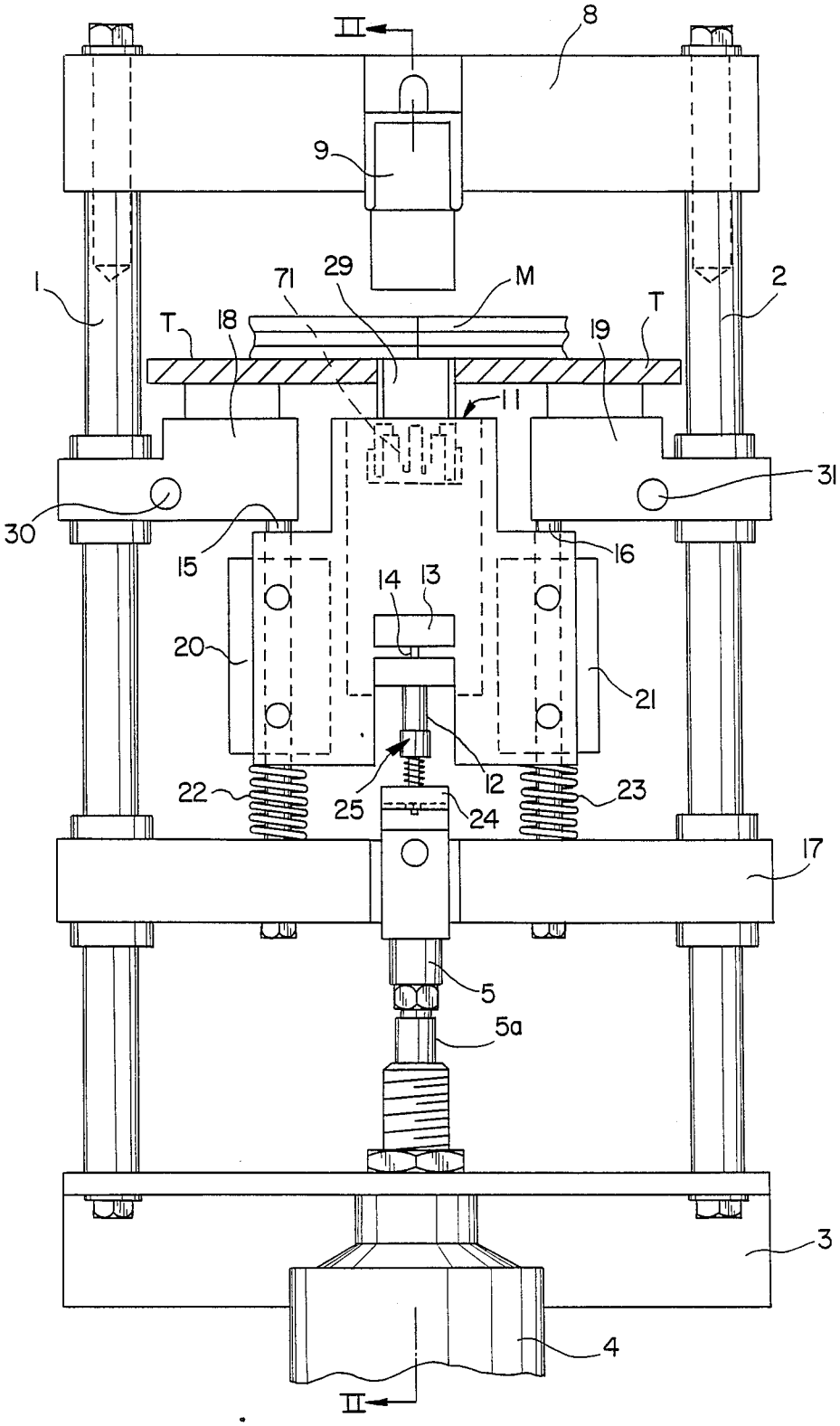
Fig. IA

DEVICE FOR ASSEMBLING, BY CLIPPING, MOLDINGS INCORPORATING SEVERAL RABBETS

This application is a continuation of application Ser. No. 636,980 filed Aug. 2, 1984, now abandoned.

The present invention relates to a device for assembling, by clipping, mouldings incorporating a plurality of rabbets.

A clipping device for making wooden frames is constituted by a fixed support generally presenting at its front end a notch on the edges of which abut the rear faces of the battens to be assembled. On this support is mounted a sliding table whose position with respect to the support is adjusted as a function of these battens. The lower part of this support comprises parallel slides on which slide two fork joints fast with sliding blocks inside which may slide columns connected in their upper part by a mobile piece and in their lower part by a base under which is mounted a pneumatic jack whose rod is connected to a pusher element which penetrates in the clip magazine.

Such a device which is described in French Patent No. 75 22814 puslished under No. 2 318,715, as well as the presently existing devices, allow assembly only of battens or mouldings having one single rabbet.

It is therefore one of the purposes of the present invention to provide a device for assembling, by clipping, mouldings incorporating several rabbets, i.e. that such a device enables clips to be placed on several parrallel planes.

A further object of the invention is to provide such a device which is easily adapted to the presently used devices such as for example on the one described in the Patent mentioned hereinabove.

These objects, as well as others which will appear hereinafter, are attained by a device for assembling, by clipping, mouldings incorporating several rabbets, which comprises a fixed table provided with means for positioning the mouldings to be assembled, slides supporting this support and rendered fast by known means with two columns which are connected in their lower part by a base under which is mounted a jack whose rod is connected to a hammer which penetrates in a clip magazine located below the support, and in their upper part by a piece fast with the two columns and provided with a presser member located substantially opposite the hammer as well as with blocking means and which according to the present invention, further comprises a clipping assembly which comprises the hammer and a sliding guide fast with the hammer as well as a sensor, two small columns on which may slide the clipping assembly, disposed between a lower support disposed between the two columns, above the base and two upper half-supports each fixed on a column, balancing means mounted on each small column below the clipping assembly, and a plate which is disposed at the top of the jack rod, and on which the hammer and the sliding guide rest and which comprises a matching member opposite the sensor with which it cooperates.

The sliding guide is advantageously of square cross-section.

The clipping assembly is preferably mounted on two bearings which may slide on the two small columns.

The sensor advantageously comprises a finger and the matching member is constituted by a rod about which is disposed an absorbing spring and which is provided at its top with a cover which may surround the finger of the sensor and retract so that the top of the rod comes into contact with this finger.

The invention will be more readily understood on reading the following description with reference to the accompanying drawings in which:

FIGS. 1A, 1B and 1C are front views of the device according to the present invention and illustrating the rest phase and two phases of operation thereof, respectively.

Figure 1B:
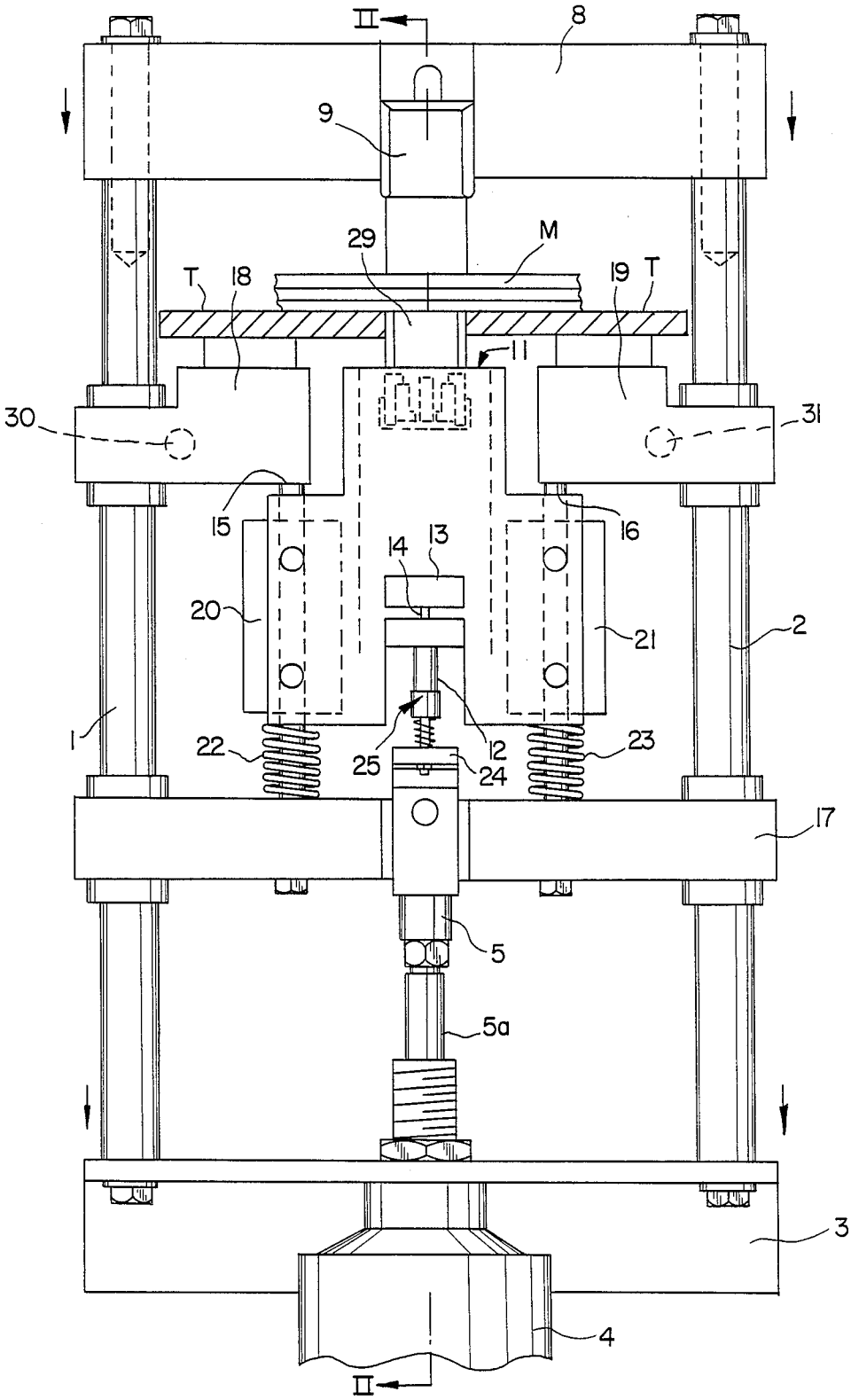
Figure 1C:
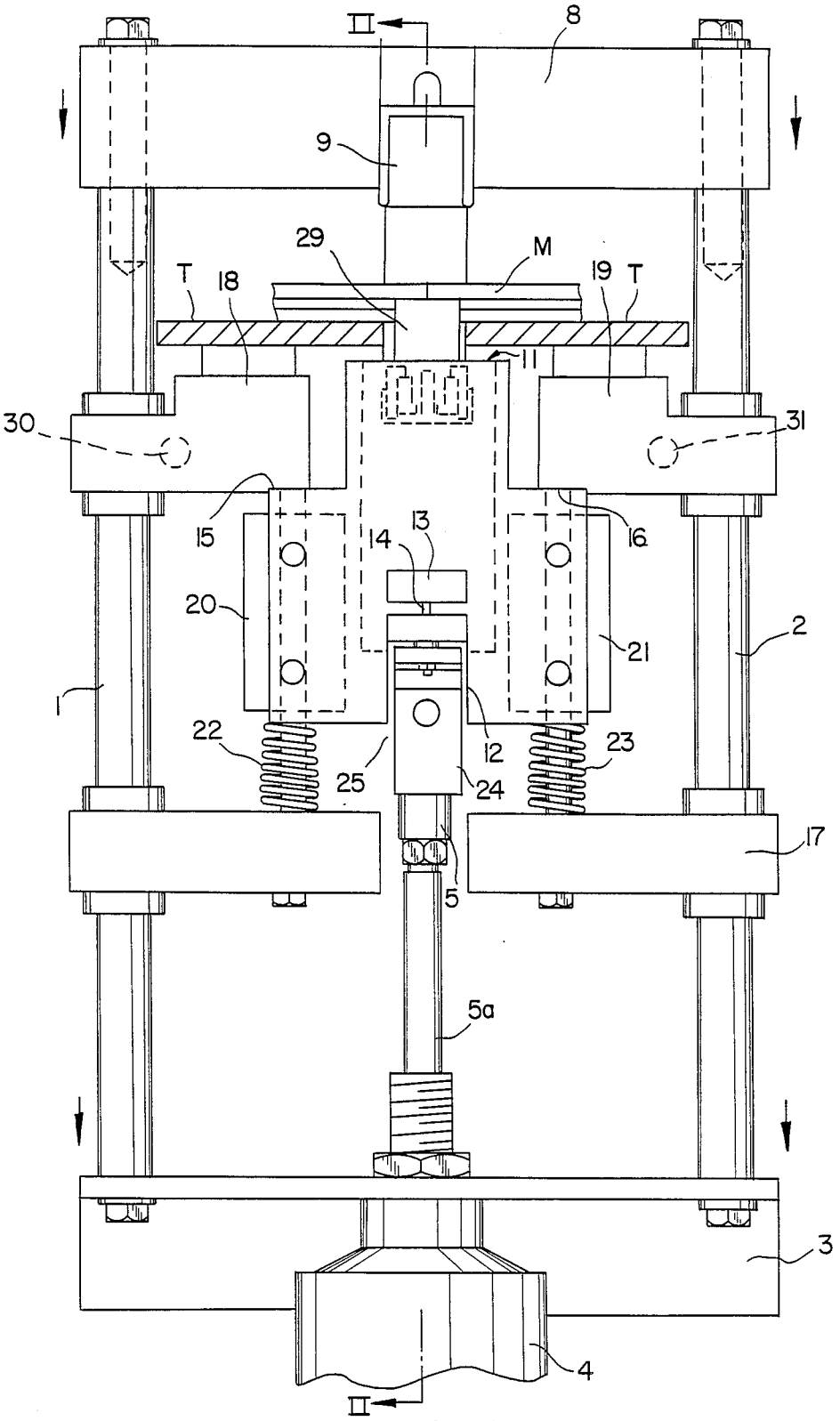
Figure 2:
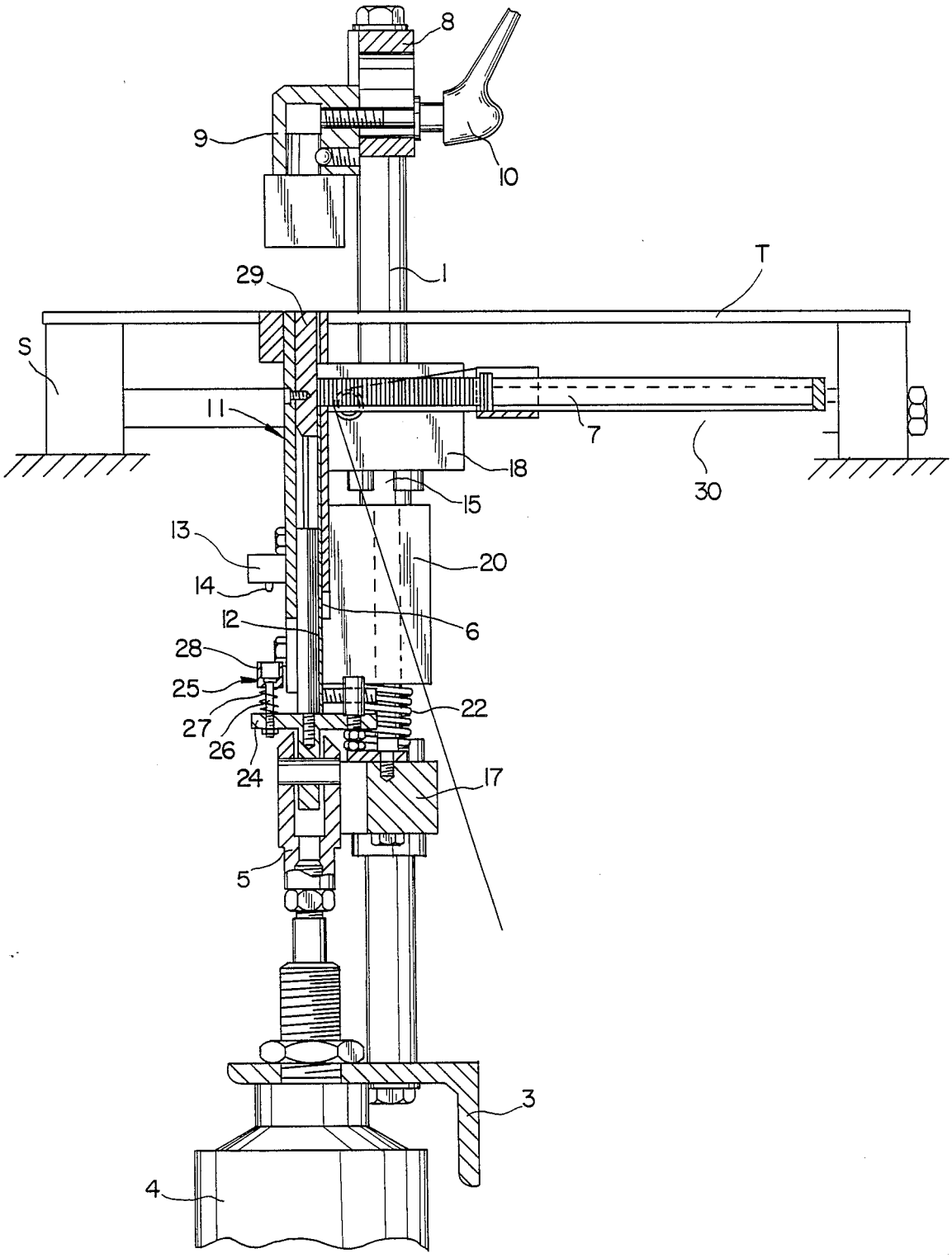
FIG. 2 is a section along axis II—II of FIG. 1, the jack being in rest position.

Referring now to the drawings, FIGS. 1 and 2 show a device for assembling, by clipping, mouldings incorporating several rabbets, which comprises a fixed support provided with means for positioning the moulding to be assembled and slides supporting this support rendered fast by known means with two columns 1 and 2. These columns are connected in their lower part by a base 3 under which is mounted a jack 4 whose rod 5*a* is connected to a hammer 6 which penetrates in a clip magazine 6 located below the support, and in their upper part by a piece 8 fast with these two columns 1 and 2. This piece 8 is provided with a presser member 9 which is located substantially opposite the hammer 6, as well as with blocking means 10.

According to the present invention, this device comprises a clipping assembly generally designated by reference 11. This assembly (FIG. 2) comprises in particular the hammer 6 and a sliding guide 12, for example of square cross-section and fast with this hammer. It comprises a sensor 13 provided with a finger 14.

This clipping assembly 11 may slide on two small columns 15 and 16 which are disposed between a lower support 17 and two upper half-supports 18 and 19. The supports 17, 18 and 19 slide themselves on the two columns 1 and 2. The clipping assembly 11 is fast with two bearings 20 and 21 which may slide respectively on the small columns 15 and 16, balancing means 22 and 23, such as springs, being interposed between the support 17 and these bearings 20 and 21.

This device comprising the clipping assembly 11 may slide horizontally on two shafts 30 and 31 cooperating with the half-supports 18 and 19, and supporting a fixed table, or work plane, provided in particular with means for positioning the mouldings to be assembled.

At the top 5 of the rod 5*a* of jack 4 there is disposed a plate 24 on which rest the sliding guide 12 and the hammer 6. A matching member 25 is disposed on this plate, substantially opposite the sensor 13. This matching member is constituted, according to the present invention, by a rod 26 about which is disposed an absorbing spring 27 and which is provided at its top with a cover 28 adapted to surround the finger 14 and to retract to allow contact between the top of the rod 26 and the finger 14 of the sensor 13.

When describing operation of this device, it will be assumed that it is in rest position, i.e. the rod 5*a* of jack 4 is retracted as shown in FIG. 2. In particular, FIG. 1A illustrates the device in rest position, the moulding M is disposed on a first table T associated with the two half-supports 18 and 19, and the jack 4 is fixed on the base and the rod 5*a* is inside the jack.

Figure 3:
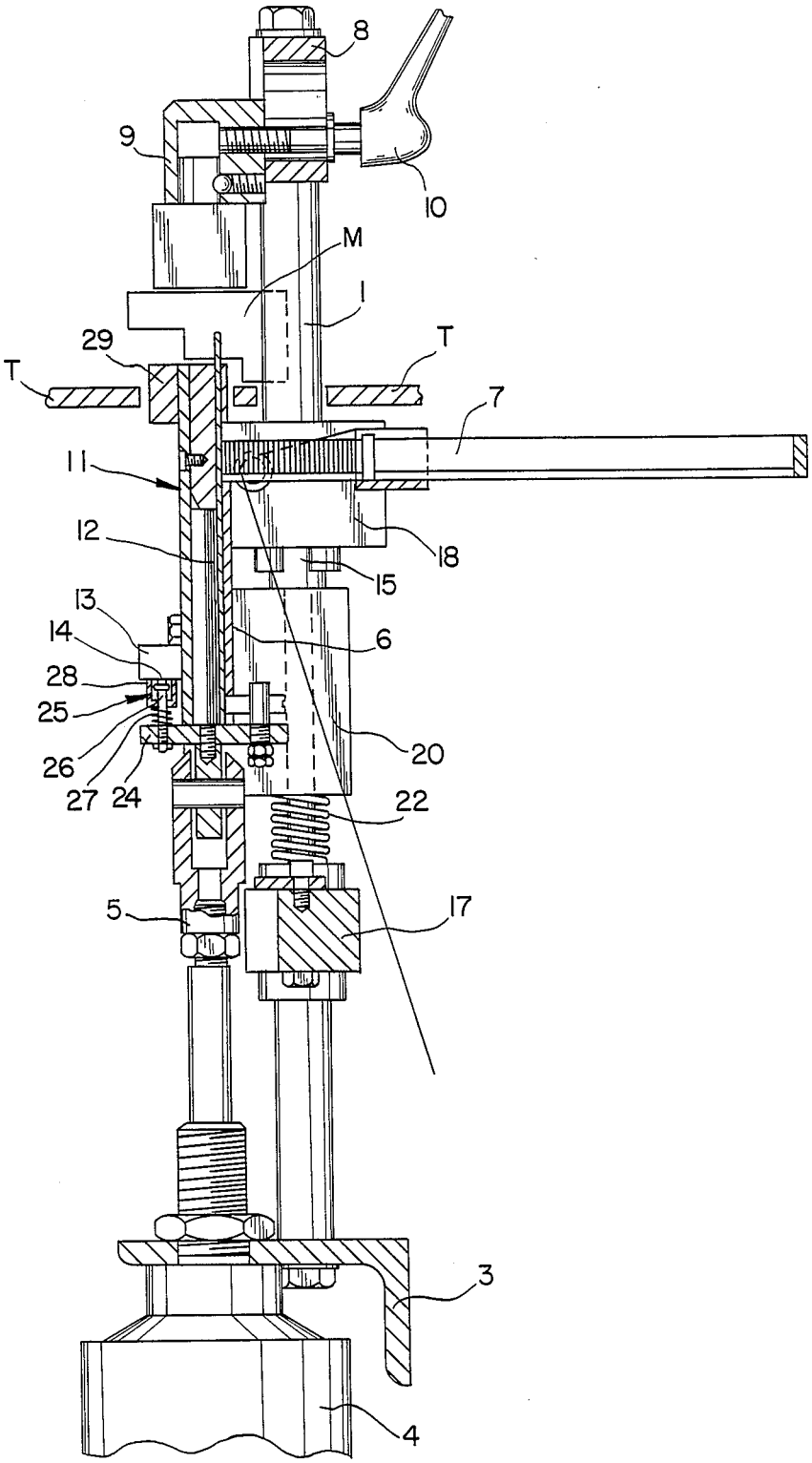
FIG. 3 is a section along axis II—II of FIG. 1, the rod of the jack being extended.

A particular cross-section of the moulding is shown in FIG. 3.

After having disposed two mouldings on the table as described for example in French patent published under no. 2 318,715, the table T being fixed on the two supports 18 and 19, the jack 4 is actuated by known means so as to extend its rod 5*a* as shown in FIG. 1B and to cause the presser member 9 previously blocked on the piece 8 by blocking means 10 which may be constituted for example by a locking key, to descend. In this first phase of operation as illustrated in FIG. 1B, because the lower support 17 is fast with supports 18 and 19 (small columns 15 and 16) and fast with regard to the table T, the extension of rod 5*a* pushes jack 4 by reaction. The jack, in turn, through the base 3, causes a descending motion of the two columns 1 and 2 which are sliding vertically in the lower support 17 and the two half supports 18 and 19. The piece 8 fast with the two columns is descending, and the presser member 9 abuts on the mouldings M on the table T. When the presser member 9 abuts on the mouldings, the plate 24 rises. In particular, in this second phase of operation as illustrated in FIG. 1C, the two columns 1 and 2 cannot descent because the presser member abuts on the mouldings M. The continued extension of rod 5*a* causes the displacement of the plate 24 upwardly along with the matching assembly, constituted by matching member 25, rod 26 spring 27 and cover 28. This assembly is raised and also contact is made between the cover 28 and the sensor 13. At this time the plate 24 is raising the clipping assembly which is sliding on the two small columns 15 and 16. This clipping assembly stops. The head 29 comes into contact with the mouldings M, at the level of the mouldings (for example the second level, see FIG. 3). The further extension of rod 5*a* causes compression of spring 27 of the matching assembly. Because the presser member abuts on the moulding M, the hammer 6 slides up to the level of the top of the head 29 and pushes a clip contained in the magazine 7 upwardly in a known manner. In particular, a clip is pushed out of the magazine after head 29 is stopped against moulding M before member 25 contacts sensor 13. Thus, a clip is pushed into the two mouldings to assemble them. When the hammer 6 stops, clip is completely introduced in the mouldings. Further the top of the rod 26 of the matching member comes into contact with the finger 14 of the sensor 13 by retraction of the cover 28 against the absorbing spring 27, then rod 5*a* of the jack stops and retracts to the position shown in FIG. 1A. The travel of the plate/jack/columns assembly is limited downward by the end of retraction of the rod 5*a* in the jack 4.

By sliding the clipping assembly 11 horizontally on the two shafts 30 and 31 and with respect to the moulding, a clip may thus be introduced into another rabbet of the moulding.

The top surface of the lower support 17 serves as a stop for the entire apparatus. In particular, the head of the screw extending downwardly from plate 24 as shown in FIGS. 2 and 3 abuts a plate on the upper surface of support 17 which serves as a stop to hold the entire apparatus, particularly components 8 and 9, in relation to table T at the rest position illustrated in FIG. 2.

To summarize, clipping assembly 11 (and bearings 20 and 21) moves up before a clip is inserted. During this movement, a clip is always next in line in the magazine over hammer 6. After head 29 is stopped against moulding M (clipping assembly 11 is also stopped), plate 24 continues its moving upwardly (caused by extension of rod 5*a*) and hammer 6, which is moving with plate 24, pushes a clip contained in the magazine (but next in line therein) into the two mouldings.

After retraction of clipping assembly 11 in the position shown in FIG. 1A, hammer 6 is in position shown in FIG. 2 and a new clip is pushed by a spring (not shown) mounted in the magazine, over the hammer. Member 12 is a guide which is fast with plate 24 and sliding in clipping assembly 11 when head 29 is against mouldings. Member 12 is the support of hammer 6.

What is claimed is:

1. A device for assembling, by clipping, mouldings incorporating several rabbets, which comprise two columns which are connected in their lower part by a base under which is mounted a jack whose rod is connected to a hammer which penetrates in a clip magazine and in their upper part by a piece fast with the two columns and provided with a presser member located substantially opposite the hammer as well as with blocking means, wherein said device further comprises a clipping assembly which comprises the hammer and a sliding guide fast with the hammer as well as a sensor; two small columns on which may slide vertically the clipping assembly, disposed between a lower support disposed between the two columns and above the base and two upper half-supports each sliding vertically on one of said columns and horizontally on shafts supporting said table, balancing means mounted on each small column below the clipping assembly; and a plate which is disposed at the top of the jack rod, and on which the hammer and the sliding guide rest and which comprises a matching member opposite the sensor with which it cooperates.

2. The device of claim 1, wherein the sliding guide is of square cross-section.

3. The device of claim 1 wherein the clipping assembly is mounted on two bearings which may slide on the two small columns.

4. The device of claim 2, wherein the clipping assembly is mounted on two bearings which may slide on the two small columns.

5. The device of claim 1, wherein the sensor comprises a finger and the matching member is constituted by a rod about which is disposed an absorbing spring and which is provided at its top with a cover which may surround the finger of the sensor and retract so that the top of the rod comes into contact with this finger.

6. The device of claim 2, wherein the sensor comprises a finger and the matching member is constituted by a rod about which is disposed an absorbing spring and which is provided at its top with a cover which may surround the finger of the sensor and retract so that the top of the rod comes into contact with this finger.

7. The device of claim 3, wherein the sensor comprises a finger and the matching member is constituted by a rod about which is disposed an absorbing spring and which is provided at its top with a cover which may surround the finger of the sensor and retract so that the top of the rod comes into contact with this finger.

8. The device of claim 5, wherein said balancing means are constituted by springs.

* * * * *